US008754811B1

(12) United States Patent
Uscinowicz et al.

(10) Patent No.: US 8,754,811 B1
(45) Date of Patent: Jun. 17, 2014

(54) DIGITAL BEAMFORMING PHASED ARRAY

(75) Inventors: Michael Uscinowicz, Hainesport, NJ (US); Fred Tanjutco, Cherry Hill, NJ (US); William Heruska, Edison, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 564 days.

(21) Appl. No.: 13/082,911

(22) Filed: Apr. 8, 2011

(51) Int. Cl.
*H01Q 3/26* (2006.01)
*H01Q 3/36* (2006.01)

(52) U.S. Cl.
USPC ..... 342/375

(58) Field of Classification Search
USPC ..... 342/157–158, 173–174, 81, 368–377; 343/853
See application file for complete search history.

(56) References Cited

U.S. PATENT DOCUMENTS

| | | | | |
|---|---|---|---|---|
| 4,373,160 | A * | 2/1983 | Cooper | 342/372 |
| 4,733,240 | A * | 3/1988 | Bradley | 342/372 |
| 5,146,616 | A * | 9/1992 | Tang et al. | 455/103 |
| 5,523,764 | A * | 6/1996 | Martinez et al. | 342/372 |
| 7,151,476 | B2 * | 12/2006 | Egri et al. | 342/25 R |
| 7,982,664 | B1 | 7/2011 | Uscinowicz | |

* cited by examiner

*Primary Examiner* — Cassie Galt
(74) *Attorney, Agent, or Firm* — Howard IP Law Group, PC

(57) ABSTRACT

A transmitter includes an array antenna and a plurality of transmitter modules. Each transmitter module includes a phase-lock loop with a slipped-cycle counter for determining the number of cycles of slippage before locking. A source of frequency reference signals is coupled to the phase-lock loop of each module by a path of unknown length. The phase of the reference signals at each module is determined from the number of slipped cycles, and a phase or delay corrector is set to compensate for differences among the modules. The modules amplify the signals to be transmitted and apply the amplified signals to the antenna array by way of paths of controlled length.

5 Claims, 13 Drawing Sheets

DIGITAL BEAMFORMING PHASED ARRAY

BACKGROUND

Typical radar systems use a single exciter or transmitter and a single receiver with the radar antenna. This helps to reduce cost and complexity. Radar performance metrics can be improved if multiple receivers and exciters are used, and also if these are positioned toward the antenna elements so as to reduce degradation due to cabling. For example, better clutter attenuation is performance can be achieved because of the de-correlation of phase noise attributable to active elements. Sub-arraying also becomes possible, thereby allowing multiple-target tracking. Improved dynamic range can be achieved by converting the received signal reflected from the target into digital form as close to the receive antenna as possible.

Calibration of the various portions of the antenna array, or more generally the radar system, may be necessary for best radar performance. This performance may include beam pointing accuracy and sidelobe levels. Calibration includes the measuring of the phase and amplitude characteristics of the transmit and receive paths or transmission lines associated with each antenna element, and applying correction factors or weights to the element paths or transmission lines to achieve the desired relative amplitude and phase tapers.

Improved radar systems are desired.

SUMMARY

A transmitter according to an aspect of the disclosure comprises an antenna array and a plurality of transmitter modules. Each of the transmitter modules includes a phase-lock loop with a slipped-cycle counter for determining the number of cycles of slippage before locking of the phase-lock loop. Each of the transmitter modules also includes an amplifier and a phase or delay corrector. The transmitter also comprises a source of plural frequency reference signals. A set of paths of various lengths is coupled to the source of plural frequency reference signals and to the phase-lock loop of each transmitter module for coupling reference signals to each transmitter module with unknown phase. A computer processor is coupled to each transmitter module, for determining the phase of the frequency reference signals at each transmitter module from the number of slipped cycles, and for setting the phase or delay corrector to compensate an amplified signal for differences among the phases of the reference signals applied to the transmitter modules. A set of paths of controlled phase or delay is coupled to the amplifiers of each transmitter module and to the corresponding antennas of the array.

A transmission system comprises a frequency source including plural ports at which mutually identical frequency reference signals are generated. An antenna array includes plural antennas, each of which defines a port. The transmission system also comprises an array of transmitter modules. Each transmitter module includes an input port to which the frequency reference signals are applied. Each transmitter module also includes an output port at which amplified signals are generated. A set of antenna paths of equal lengths is provided. Each of the antenna paths extends from an output port of one of the transmitter modules to a port of an associated one of the antennas of the antenna array. Each of the reference signal paths of a set of reference signal paths is connected between one of the ports of the frequency source and the input port of one of the transmitter modules. The lengths of the reference signal paths may vary from one to the next. Each of the transmitter modules of the array of transmitter modules includes a phase-lock loop arrangement for synchronizing an associated transmitter module oscillator with that one of the frequency reference signals applied to the input port of the transmitter module. The phase-lock loop arrangement of each transmitter module includes a slipped-cycle counter for counting the number of cycles of operation slipped during locking of the phase-locked loop arrangement. In a particular embodiment, a processor determines from the number of slipped cycles the phase or delay of each reference signal path. A particularly advantageous embodiment further comprises a phase shifter or delay element associated with each transmitter module, where the phase shifter or delay element is set to a phase or delay value which tends to equalize the phase or delay between the source and the ports of the associated antennas.

A method for transmitting electromagnetic signals according to an aspect of the disclosure comprises the steps of generating plural replicas of a frequency reference signal, and applying each of the plural replicas by way of a path of uncontrolled delay to a transmit module of a set of transmit modules. Within each of the transmit modules, a controlled oscillator is phase locked to one of the plural replicas. The number of slipped cycles which occur during the phase locking is counted. From the number of the slipped cycles, the electrical delay of the corresponding path of uncontrolled delay is determined. The output signal of each of the controlled oscillators is delayed by a selected delay. The selected delay is selected to nominally equalize the phases of the delayed output signals of all of the controlled oscillators. The delayed output signal of each of the controlled oscillators is applied to a corresponding antenna element of an antenna array. A particular mode of this method further comprises the step of imposing a further delay on the delayed output signals of each of the controlled oscillators to direct a beam of electromagnetic radiation from the antenna array.

DETAILED DESCRIPTION

Figure 1A:
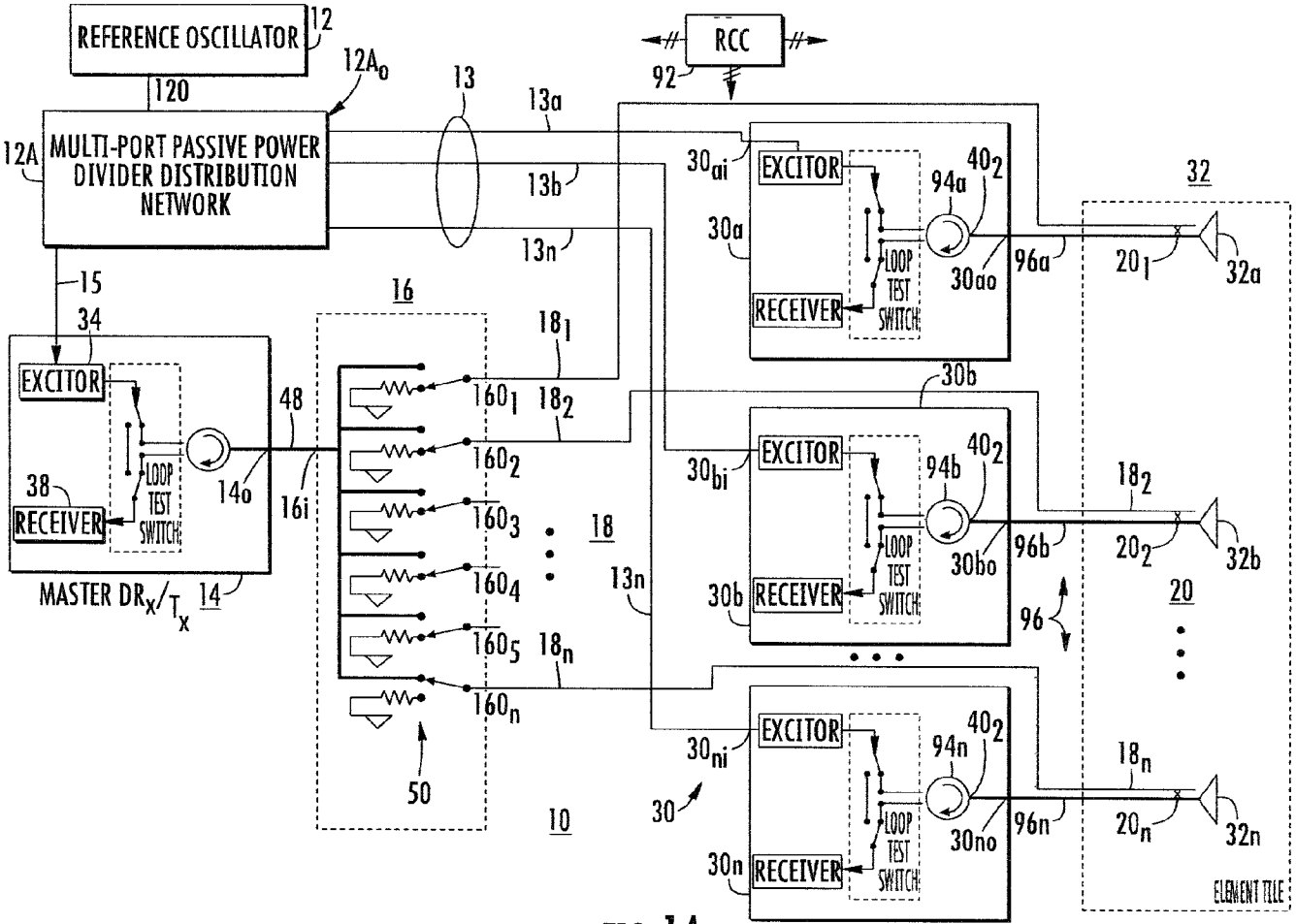
FIG. 1A is a simplified block and schematic diagram illustrating a radar system according to an aspect of the disclosure, where the radar system includes a reference oscillator, a plurality of antenna elements of an antenna array, a master Digital Receiver-Transmitter (DRx/Tx) unit, a plurality of ancillary Digital Receiver-Transmitter (DRx/Tx) units, each of which is coupled to one of the antenna elements, a switch matrix, and interconnecting signal paths.

Beamforming is a signal processing technique used in sensor arrays for directional signal transmission or reception. This directional or spatial selectivity is achieved by using adaptive or fixed receive/transmit beam patterns. The improvement provided by spatial selectivity compared with omnidirectional reception or transmission is known as receive or transmit gain (or loss). Beamforming can be used for both radio and sound waves, and has found numerous applications in radar, sonar, seismology, wireless communications, radio astronomy, speech, acoustics, and biomedicine. Those skilled in the art know that sonar and radar systems have many aspects in common, and can readily apply principles of one to the other. Beamforming takes advantage of interference to change the directionality of the sensors of the array. These sensors may be transponders such as sound projectors or receiving hydrophones in a sonar context or electromagnetic antennas and antenna arrays in a radar context. During transmission from an array of transponders, a beamformer controls the phase and relative amplitude of the signal at each transponder in order to create a pattern of constructive and destructive interference in the wavefront. When receiving signals by means of an array of transducers or sensors, information from the various sensors is combined in such a way that the expected pattern of radiation is preferentially observed.

In order to send a directive beam of sound or electromagnetic energy toward a ship in the distance, simply transmitting a simultaneous pulse from every transducer in an array will not provide greatest directivity, because the ship will first perceive the transmitted pulse from the transducer that happens to be nearest the ship, and only later perceive pulses from transducers that happen to be the further from the ship. The beamforming technique involves sending the pulse from each transducer at slightly different times. The pulse is sent last from that transducer that is closest to the ship, so that every pulse hits the ship at exactly the same time, thereby producing the effect of a single strong pulse from a single powerful transducer. As mentioned, this action can be carried out in water in a sonar context using projectors, and the same action can be carried out in air using loudspeakers, or in an electromagnetic context (radar or radio) using antennas. Beamforming can be performed with continuous-wave signals as well as with pulsed signals.

In passive radar or sonar, and in reception in active radar or sonar, the beamforming technique involves combining delayed signals from each hydrophone or antenna at slightly different times, as for example the transducer closest to the target is combined after the longest delay, so that every signal reaches the output at exactly the same time, making one intense signal, as if the signal came from a single, very sensitive transducer. Receive beamforming can also be used with microphones or radar antennas.

The arrays of transducers may be one-dimensional, as in a line array, or may be two-dimensional, as in a planar array. One-dimensional arrays are capable of concentrating energy in a single plane, while two-dimensional arrays are capable of concentrating energy into one or more sharply defined "pencil" beams. Three-dimensional arrays similar to curved planar arrays are also known.

In narrow-band systems, the time delay applied to a transponder, projector, hydrophone, or antenna is equivalent to a "phase shift", so in the case of array of antennas, the signal applied to each one is phase shifted by a slightly different amount than for other antennas. Antenna systems using such techniques are known as phased-array antennas. A narrow band system, as is typical of radar systems, is one in which the bandwidth is only a small fraction of the center frequency. In the case of wideband systems, typical of sonar systems, this approximation does not apply. In the receive beamformer the signal from each antenna may be amplified by a different "weight." Different weighting patterns can be used to achieve the desired sensitivity patterns. A main lobe is produced, together with sidelobes spaced apart from the main lobe and from each other by nulls. As well as controlling the main lobe width (the beam) and the sidelobe levels, the position of a null can be controlled. This is useful to ignore noise or jammers in one particular direction, while listening for events in other directions. A similar result can be obtained on transmission.

Figure 1B:
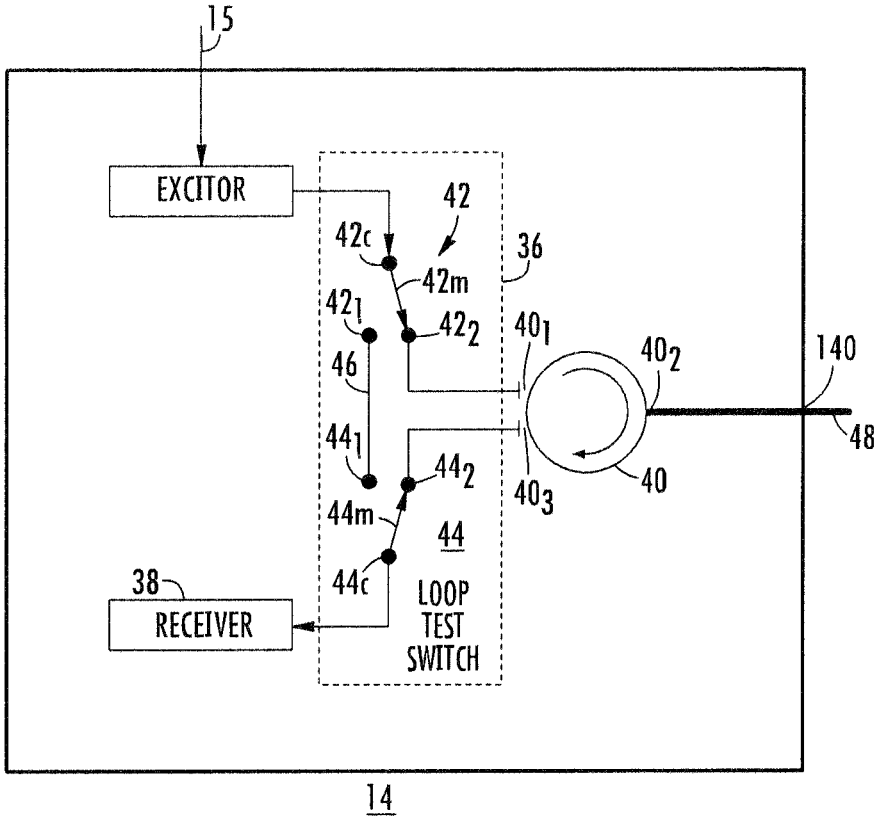
FIG. 1B is a more detailed diagram of the master Digital Receiver-Transmitter (DRx/Tx) unit of FIG. 1A.

FIG. 1A is a simplified block diagram of a radar system 10 according to an aspect of the disclosure. In FIG. 1, a reference oscillator 12 produces a clock signal. The clock signal, which may be at a frequency of around 100 MHz, is applied by way of a transmission line or path 120, to a Multi-Port Passive Power Divider Distribution Network 12A and a path 15 to a master exciter or transmitter 34. Since Multiport Passive Power Divider Distribution Network 12A is simply a divider, the same clock signal passes through path 15 as is applied to Network 12A. Master exciter or transmitter 34 is contained in the master Digital Receiver/transmitter (DRx/Tx) unit illustrated as a block 14. Details of master Digital Receiver/Transmitter 14 appear in FIG. 1B. As illustrated in FIG. 1B, the master Digital Receiver/transmitter unit (DRx/Tx) 14 contains digital exciter or transmitter 34, which receives the clock signal by way of path 15. Exciter 34 of FIG. 1B produces a signal which can be applied by way of a loop test switch arrangement 36 to a digital receiver 38 or to a circulator 40. Loop test switch 36 of FIG. 1B includes first and second single-pole, double-throw switch elements illustrated by mechanical switch symbols 42 and 44. Those skilled in the art know that mechanical switches are not ordinarily used in modern equipment, but that they are useful in explaining equipment operation. Instead of mechanical switches, electronic switches are ordinarily used in practice. In FIG. 1*b*, switch element 42 includes a common terminal, contact or port 42*c*. A "movable" switch element 42*m* makes contact with the common terminal 42*c* and can be moved to make contact alternately with either of independent terminals $\mathbf{42}_1$ and $\mathbf{42}_2$. In the illustrated position of movable element 42*m*, signal from exciter 34 flows by way of terminal 42*c*, movable element 42*m*, and terminal $\mathbf{42}_2$ to an input port $\mathbf{40}_1$ of a circulator 40. From input port $\mathbf{40}_1$ of circulator 40, the exciter signal flows in the direction of the circulation arrow to port $\mathbf{40}_2$ of circulator 40, and thence to output port 140 of master Digital Receiver/Transmitter (DRx/Tx) unit 14. As known to those skilled in the art, signal applied to circulator port $\mathbf{40}_2$ from port 14*o* circulates principally to port $\mathbf{40}_3$ and not to port $\mathbf{40}_1$. Also in loop test switch 36 of FIG. 1B, a further switch 44 includes a common terminal 44*c* connected to an input port of receiver 38, and a "movable" element 44*m* which makes contact with the common terminal 44*c*. Movable element 44*m* can be moved to make contact with either of two independent terminals, namely independent terminals $\mathbf{44}_1$ and $\mathbf{44}_2$. Independent terminals $\mathbf{42}_1$ and $\mathbf{44}_1$ of switches 42 and 44, respectively, are connected together by a path 46, so that in the alternate position of switches 42 and 44, signal from exciter 34 can be applied to receiver 38.

Exciter signal routed by loop test switch arrangement 36 of FIG. 1B to circulator 40 is further routed, as illustrated in FIG. 1A, by way of a path 48 and a port 140 of Digital Receiver/Transmitter unit 14 to a port 16*i* of a horizontal or vertical matrix of switches represented as a block 16. The term "horizontal" or "vertical" refers to the direction of the linear array of antenna elements associated with the switches; those skilled in the art will understand that both horizontal and vertical arrays are used in practice, rather than only one as illustrated. In FIG. 1A, the horizontal or vertical array 32 of antenna elements includes antenna elements 32*a*, 32*b*, . . . , 32*n* of a set 32 of antennas. The matrix 16 of switches of FIG. 1A routes the signal between reference digital Receiver/Transmitter 14 and a selected one of Digital Receiver/- (DRx/Tx) 30*a*, 30*b*, . . . , 30*n* of a set 30 of digital Receiver/Transmitters which is to be under test. This route extends from matrix 16 of switches, by way of a path of set 18 of paths, to a directional coupler of a set 20 of directional couplers, and thence to the appropriate one of the Digital Receiver/transmitter (DRx/Tx) of set 30 of DRx/Txs. This allows the various DRx/Txs of set 30 to be synchronized with the master DRx/Tx 14 of FIG. 1A.

The individual Digital Receiver/Transmitters (DRx/Tx) of set 30 of FIG. 1A are identical to master DRx/Tx 14. The common ports (corresponding to port $\mathbf{40}_2$ of FIG. 1B) of the circulators 94*a*, 94*b*, . . . , 94*n* of DRx/Tx of set 30 of FIG. 1A are coupled by way of individual paths to directional couplers of a set 20 of directional couplers $\mathbf{20}_1$, $\mathbf{20}_2$, . . . , 20*n*. Depending upon the direction of signal flow, this may or may not interconnect an individual antenna of set 32 of antennas to a corresponding DRx/Tx. For example, the "common" port $\mathbf{40}_2$ of the circulator $\mathbf{94}_a$ of DRx/Tx 30*a* of FIG. 1A is coupled by way of a port 30*ao* and a path 96*a* to directional coupler $\mathbf{20}_1$. Depending upon the direction of signal flow through directional coupler $\mathbf{20}_1$, port 30*ao* may receive signals originating from antenna 32*a* or from master DRx/Tx 14, or may apply signals to antenna 32*a* or to receiver 38 of master DRx/Tx 14. Similarly, the common port $\mathbf{40}_2$ of the circulator 94*b* of DRx/Tx 30*b* of FIG. 1A is coupled by way of a port 30*bo* and a path 96*b* to directional coupler $\mathbf{20}_2$. Depending upon the direction of signal flow through directional coupler $\mathbf{20}_2$, port 30*bo* may receive signals originating from antenna 32*b* or from master DRx/Tx 14, or may apply signals to antenna 32*b* or to receiver 38 of master DRx/Tx 14.

Figure 1C:
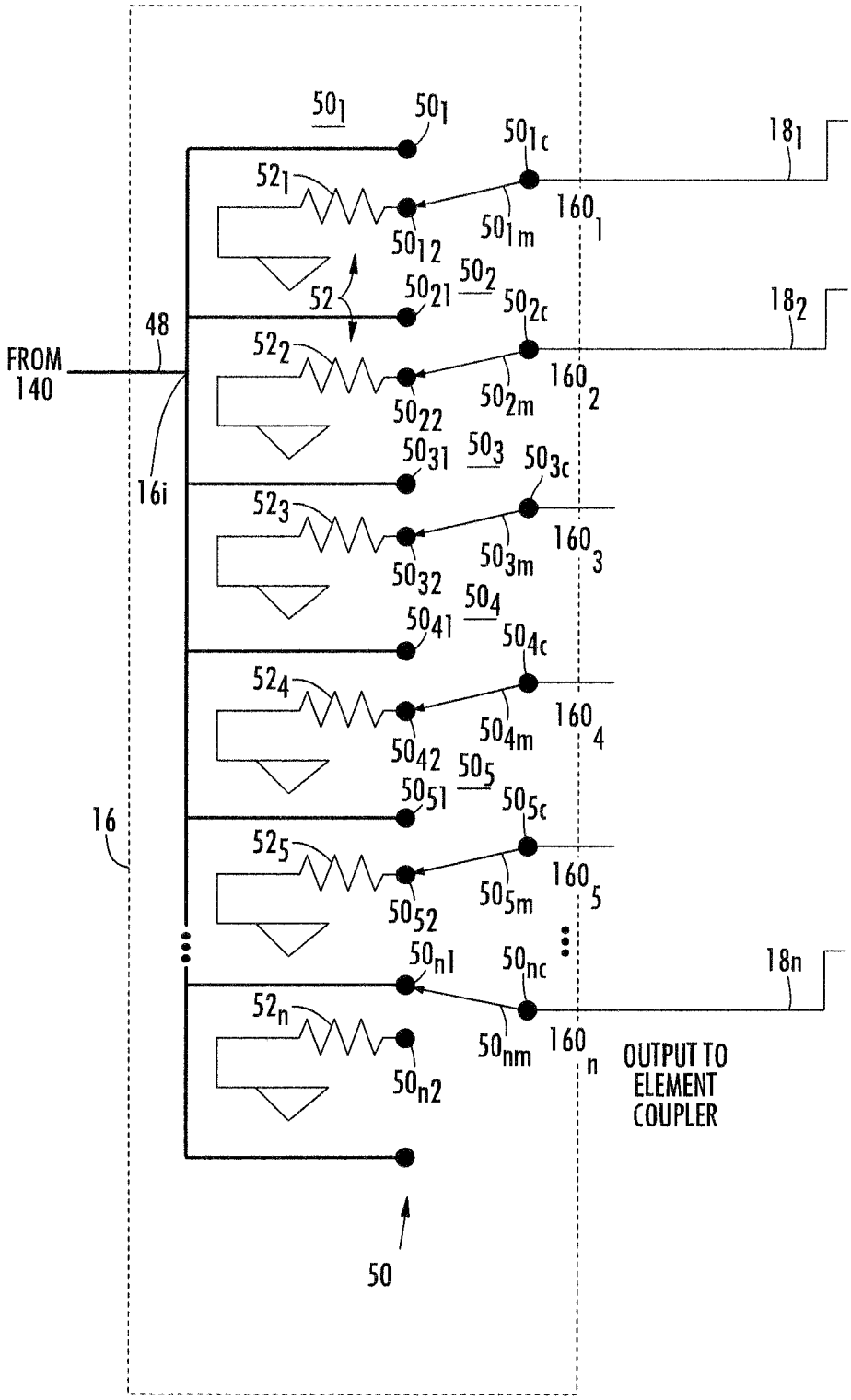
FIG. 1C is a more detailed diagram of the switch matrix of FIG. 1A.

Details of switch block matrix 16 of FIG. 1A appear in FIG. 1C. In FIG. 1C, signals are routed between path 48 (at input port 16*i*) and one of the ports $\mathbf{160}_1$, $\mathbf{160}_2$, $\mathbf{160}_3$, $\mathbf{160}_4$, $\mathbf{160}_5$, . . . , $\mathbf{16}o_n$ of set 16*o* of ports of the switch matrix 16. The switches $\mathbf{50}_1$, $\mathbf{50}_2$, $\mathbf{50}_3$, $\mathbf{50}_4$, $\mathbf{50}_5$, and $\mathbf{50}_n$ of switch block 16 are represented by mechanical switch symbols. Six switches $\mathbf{50}_1$, $\mathbf{50}_2$, $\mathbf{50}_3$, $\mathbf{50}_4$, $\mathbf{50}_5$, and $\mathbf{50}_n$ of a set 50 of switches are illustrated in FIG. 1C, but a greater or lesser number can be used. Switch $\mathbf{50}_1$ includes a common terminal $\mathbf{50}_1c$, which is connected to output port $\mathbf{160}_1$, and also includes first and second individual or independent terminals, designated $\mathbf{50}_1\mathbf{1}$ and $\mathbf{50}_1\mathbf{2}$. Switch $\mathbf{50}_1$ also includes a movable element $\mathbf{50}_1m$ which is connected to common terminal $\mathbf{50}_1c$ and is movable to contact either of the individual terminals $\mathbf{50}_1\mathbf{1}$ and $\mathbf{50}_1\mathbf{2}$. Terminal $\mathbf{50}_1\mathbf{1}$ is connected to path 48, and terminal $\mathbf{50}_1\mathbf{2}$ is connected to ground or reference potential by way of a matching resistor $\mathbf{52}_1$. The common terminal $\mathbf{50}_1c$ connects to a conductive path $\mathbf{18}_1$ of a set 18 of paths. Switch $\mathbf{50}_2$ includes a common terminal $\mathbf{50}_2c$, which is connected to output port $\mathbf{160}_2$, and also includes first and second individual or independent terminals, designated $\mathbf{50}_2\mathbf{1}$ and $\mathbf{50}_2\mathbf{2}$. Switch $\mathbf{50}_2$ also includes a movable element $\mathbf{50}_2m$ which is connected to common terminal $\mathbf{50}_2c$ and is movable to contact individual terminals $\mathbf{50}_2\mathbf{1}$ and $\mathbf{50}_2\mathbf{2}$. Terminal $\mathbf{50}_2\mathbf{1}$ is connected to path 48, and terminal $\mathbf{50}_2\mathbf{2}$ is connected to ground or reference potential by way of a matching resistor $\mathbf{52}_2$. Common terminal $\mathbf{50}_2c$ also connects to a path $\mathbf{18}_2$ of set 18 of paths. Switch $\mathbf{50}_3$ includes a common terminal $\mathbf{50}_3c$, which is connected to output port $\mathbf{160}_3$, and also includes first and second individual or independent terminals, designated $\mathbf{50}_3\mathbf{1}$ and $\mathbf{50}_3\mathbf{2}$. Switch $\mathbf{50}_3$ also includes a movable element $\mathbf{50}_3m$ which is connected to common terminal $\mathbf{50}_3c$ and is movable to contact individual terminals $\mathbf{50}_3\mathbf{1}$ and $\mathbf{50}_3\mathbf{2}$. Common terminal $\mathbf{50}_3c$ also connects to a path (not illustrated) of set 18 of paths. Terminal $\mathbf{50}_3\mathbf{1}$ is connected to path 48, and terminal $\mathbf{50}_3\mathbf{2}$ is connected to ground or reference potential by way of a matching resistor $\mathbf{52}_3$. Switch $\mathbf{50}_4$ includes a common terminal $\mathbf{50}_4c$, which is connected to output port $\mathbf{160}_4$, and also includes first and second individual or independent terminals, designated $\mathbf{50}_4\mathbf{1}$ and $\mathbf{50}_4\mathbf{2}$. Common terminal $\mathbf{50}_4c$ also connects to a path (not illustrated) of set 18 of paths. Switch $\mathbf{50}_4$ also includes a movable element $\mathbf{50}_4m$ which is connected to common terminal $\mathbf{50}_4c$ and is movable to contact individual terminals $\mathbf{50}_4\mathbf{1}$ and $\mathbf{50}_4\mathbf{2}$. Terminal $\mathbf{50}_4\mathbf{1}$ is connected to path 48, and terminal $\mathbf{50}_4\mathbf{2}$ is connected to ground or reference potential by way of a matching resistor $\mathbf{52}_4$. Switch $\mathbf{50}_5$ includes a common terminal $\mathbf{50}_5c$, which is connected to output port $\mathbf{160}_5$, and also includes first and second individual or independent terminals, designated $\mathbf{50}_5\mathbf{1}$ and $\mathbf{50}_5\mathbf{2}$. Common terminal $\mathbf{50}_5c$ also connects to a path (not illustrated) of set 18 of paths. Switch $\mathbf{50}_5$ also includes a movable element $\mathbf{50}_5m$ which is connected to common terminal $\mathbf{50}_5c$ and is movable to contact individual terminals $\mathbf{50}_5\mathbf{1}$ and $\mathbf{50}_5\mathbf{2}$. Terminal $\mathbf{50}_5\mathbf{1}$ is connected to path 48, and terminal $\mathbf{50}_5\mathbf{2}$ is connected to ground or reference potential by way of a matching resistor $\mathbf{52}_5$. Similarly, switch $\mathbf{50}_n$ includes a common terminal $\mathbf{50}_nc$, which is connected to output port $\mathbf{160}_n$, and also includes first and second individual or independent terminals, designated $\mathbf{50}_n\mathbf{1}$ and $\mathbf{50}_n\mathbf{2}$. Common terminal $\mathbf{50}_nc$ also connects to a path $\mathbf{18}_n$ of set 18 of paths. Switch $\mathbf{50}_n$ also includes a movable element $\mathbf{50}_nm$ which is connected to common terminal $\mathbf{50}_nc$ and is movable to contact individual terminals $\mathbf{50}_n\mathbf{1}$ and $\mathbf{50}_n\mathbf{2}$. Terminal $\mathbf{50}_n\mathbf{1}$ is connected to path 48, and terminal $\mathbf{50}_n\mathbf{2}$ is connected to ground or reference potential by way of a matching resistor $\mathbf{52}_n$. It will be noted that the positions of the movable elements of all of the switches $\mathbf{50}_1$, $\mathbf{50}_2$, $\mathbf{50}_3$, $\mathbf{50}_4$, and $\mathbf{50}_5$ of switch matrix 16 are set such that contact is made between the common terminal and the matching resistor of set 52. Only one of the switches, in this example switch $\mathbf{50}_n$, has its movable element $\mathbf{50}_nm$ connected to path 48. Thus, for the switch settings illustrated in FIG. 1C, only switch $\mathbf{50}_n$ provides communication between the Digital Receiver/transmitter (DRx/Tx) unit illustrated in block 14 and a Digital Receiver/transmitter (DRx/Tx) unit under test of set 30 of DRx/Tx units, in this case DRx/Tx 30*n*. The path by which signals may travel from Digital Receiver/Transmitter (DRx/Tx) unit 14 of FIG. 1A and a Receiver/Transmitter (DRx/Tx) unit under test 30*n* includes path 18*n*, directional coupler 20*n*, and path 96*n* of a set 96 of paths.

Figure 1D:
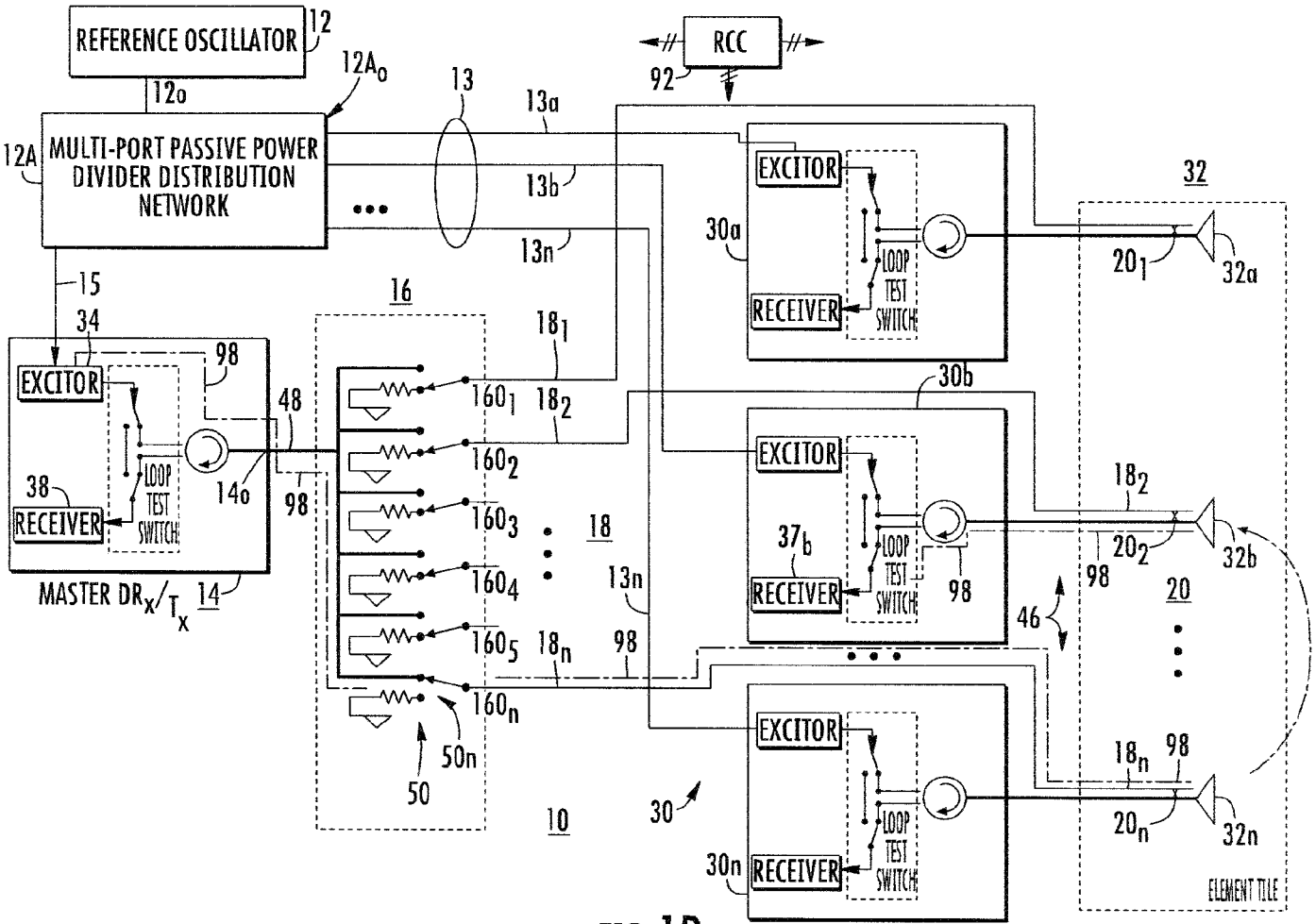
FIG. 1D is similar to FIG. 1A but includes identification of a calibration signal flow path.

In FIG. 1D, exciter signals from exciter 34 of master Digital Receiver/Transmitter (DRx/Tx) 14 flow through switch block 16 and by way of a path of set 18 of paths to a directional coupler of set 20 of directional couplers, and are applied to the associated radiating element of set 32 of radiating elements. The exciter signal is coupled to the adjacent radiating element, and to its associated DRx/Tx. For example, the exciter signal from exciter 34 of master DRx/Tx 14 flows by way of path 48 to switch element 50*n* of switch matrix 16, and thence by way of path 18*n* to directional coupler 20*n*, and to radiating element 32*n* of element tile 32, as illustrated by the path of chain line 98. The signal is radiated from element 32*n* to an adjacent radiating element, illustrated as element 32*b*, which transduces the signal and couples the transduced signal through the through path of directional coupler $\mathbf{20}_2$ and a circulator of DRx/Tx 30*b* to the digital receiver 37*b* of DRx/Tx 30*b*. The traversal of the signal path from master exciter 34 of master Digital Receiver/Transmitter (DRx/Tx) 14 and through antenna elements 32*n* and 32*b*, and thence to receiver 37*b* is intended to provide a calibration signal path from the reference transmitter/receiver (master DRx/Tx) 34 to the intended receiver/transmitter under test 37*b*. Each DRx/Tx (set 30) in the system is provided a direct signal path to the master DRx/Tx 34 and in the same way, each antenna element in the element tile 32 is connected to its own Digital Receiver/Transmitter (DRx/Tx) unit of set 30. Switch matrix assembly 16 routes the desired signal from any Digital Receiver/Transmitter unit of set 30, such as Digital Receiver/Transmitter unit 30*a*, to the reference Digital Receiver/Transmitter unit 14. Reference DRx/Tx 14 serves as the common Receiver used to characterize/calibrate all the individual Tx paths of all the DRx/Tx units of set 30, and reference DRx/Tx 14 serves as the common Exciter to characterize/calibrate all the Rx paths of DRx/Tx units of set 30. Signal variations from element path to element path are recorded and the correction to be applied to each individual path is calculated from these element path to path measurements.

Also in FIG. 1A, the master reference oscillator signals originating from block 12 are applied by way of multi-port passive power divider distribution block 12A and paths 13*a*, 13*b*, . . . , 13*n* of set 13 of paths to the exciters of DRx/Tx 30*a*, 30*b*, . . . 30*n* of set 30 of DRx/Tx units.

Typical radar systems use a single exciter and a single receiver with a single directive antenna, which helps to save cost and complexity. Radar performance metrics are improved by positioning multiple receivers and exciters toward the radiating elements or antennas of an array antenna. For example, improved clutter attenuation performance can be achieved by virtue of de-correlation of the phase noise arising from active components. Sub-arraying becomes possible with such multiple receivers and exciters, and this in turn allows simultaneous tracking of multiple targets. In reception of reflected radar signals, improved dynamic range can be achieved if the analog signal is converted to digital form at a location close to the antenna elements.

Figure 2:
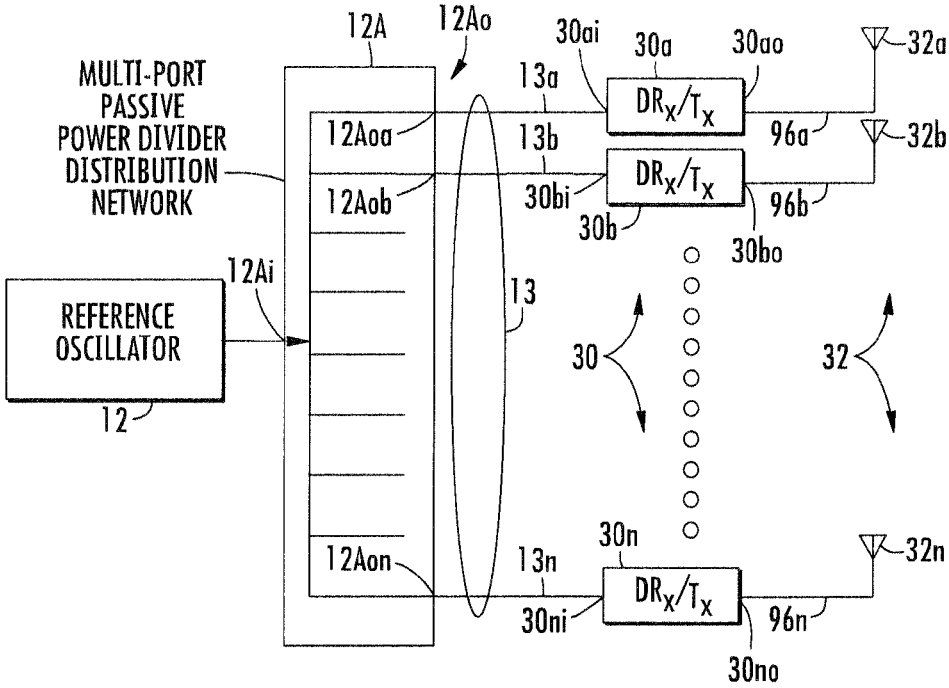
FIG. 2 is a simplified illustration representing the reference oscillator and a distribution arrangement equivalent to FIG. 1A, for distributing the reference oscillator signal to the various DRx/Tx units.

While improvements in performance can be achieved by using a separate exciter for each antenna element, critical antenna performance parameters such as beam pointing accuracy and sidelobe level require that the electromagnetic signals "combine in space" with the correct phase and amplitude. Simple provision of multiple exciter sources does not guarantee that the sources are at the same frequency, much less at the same phase. FIG. 2 is a simplified diagram conceptually illustrating how a single exciter can produce the exciter signals for a plurality of Digital Receiver-Transmitter (DRx/Tx) units. Elements of FIG. 2 corresponding to those of FIG. 1A are designated by like alphanumerics. In FIG. 2, a single reference oscillator illustrated as a block 12 is coupled to an input port 12Ai of a multi-port passive power divider distribution network 12A. The term "coupled" includes both the presence and absence of intermediary elements. Multi-port passive power divider distribution network 12A divides the reference oscillator signal applied to its input port 12Ai into as many portions as there exist users for the reference oscillator signal. These divided reference oscillator signals appear at output ports 12Aoa, 12Aob . . . , 12Aon of a set 12Ao of output ports. The reference oscillator signals appearing at set 12Ao of output ports are applied by way of individual signal paths, designated together as 13, to individual ones of the user DRx/Tx devices of set 30 of DRx/Tx units. For example, the divided portion of the reference oscillator 12 signal appearing at output port 12Aoa of divider 12A is applied over a path 13*a* to an input port 30*ai* of a DRx/Tx 30*a*, the divided portion of the reference oscillator 12 signal appearing at output port 12Aob of divider 12A is applied over a path 13*b* to an input port 30*bi* of a DRx/Tx 30*b*, . . . , and the divided portion of the reference oscillator 12 signal appearing at output port 12Aon of divider 12A is applied over a path 13*n* to an input port 30*ni* of a DRx/Tx 30*n*. Even if the signals appearing at the output ports 12Aoa, 12Aob, . . . , 12Aon of divider 12A are at the same frequency and phase, the lengths of the transmission paths of set 13 may differ one from the next, with the result that the frequency and phase control of the signals required for sophisticated radar operations are compromised.

In another aspect of the disclosure, the reference oscillator 12 of FIG. 2 synchronizes the frequency of all of the individual exciters of the array 30 of DRx/Txs of FIG. 1A. In a further aspect of the disclosure, the path lengths within the various DRx/Txs are calibrated, and in a still further aspect of the disclosure, the lengths of the paths of set 13 of paths extending from the reference exciter to the individual DRx/Txs are calibrated, so that not only the frequencies, but also the phases of the individual DRx/Txs are synchronized. Calibration of radar system path lengths is known in general, as for example from U.S. patent application Ser. No. 12/472,864, filed May 27, 2009 and issued as U.S. Pat. No. 7,982,664 "Radar Calibration Structure and Method" in the name of Michael Uscinowicz.

Those skilled in the arts of antenna arrays and beamformers know that antennas are transducers which transduce electromagnetic energy between unguided- and guided-wave forms. More particularly, the unguided form of electromagnetic energy is that propagating in "free space," while guided electromagnetic energy follows a defined path established by a "transmission line" of some sort. Transmission lines include coaxial cables, rectangular and circular conductive waveguides, dielectric paths, and the like. Antennas are totally reciprocal devices, which have the same beam characteristics in both transmission and reception modes. For historic reasons, the guided-wave port of an antenna is termed a "feed" port, regardless of whether the antenna operates in transmission or reception. As illustrated in the simplified representation of FIG. 2, each DRx/Tx of set 30 is coupled to the "feed port" of an antenna element of antenna array 32. More particularly, a transmit-receive port 30*ao* of DRx/Tx 30*a* is coupled by way of a path 96*a* to antenna element 32*a* of array 32, a transmit-receive port 30*bo* of DRx/Tx 30*b* is coupled by way of a path 96*b* to antenna element 32*b* of array 32 . . . , and a transmit-receive port 30*no* of DRx/Tx 30*n* is coupled by way of a path 96*n* to antenna element 32*n* of array 32. The term "coupled" in this context includes both absence and presence of intermediary elements.

Figure 3A:
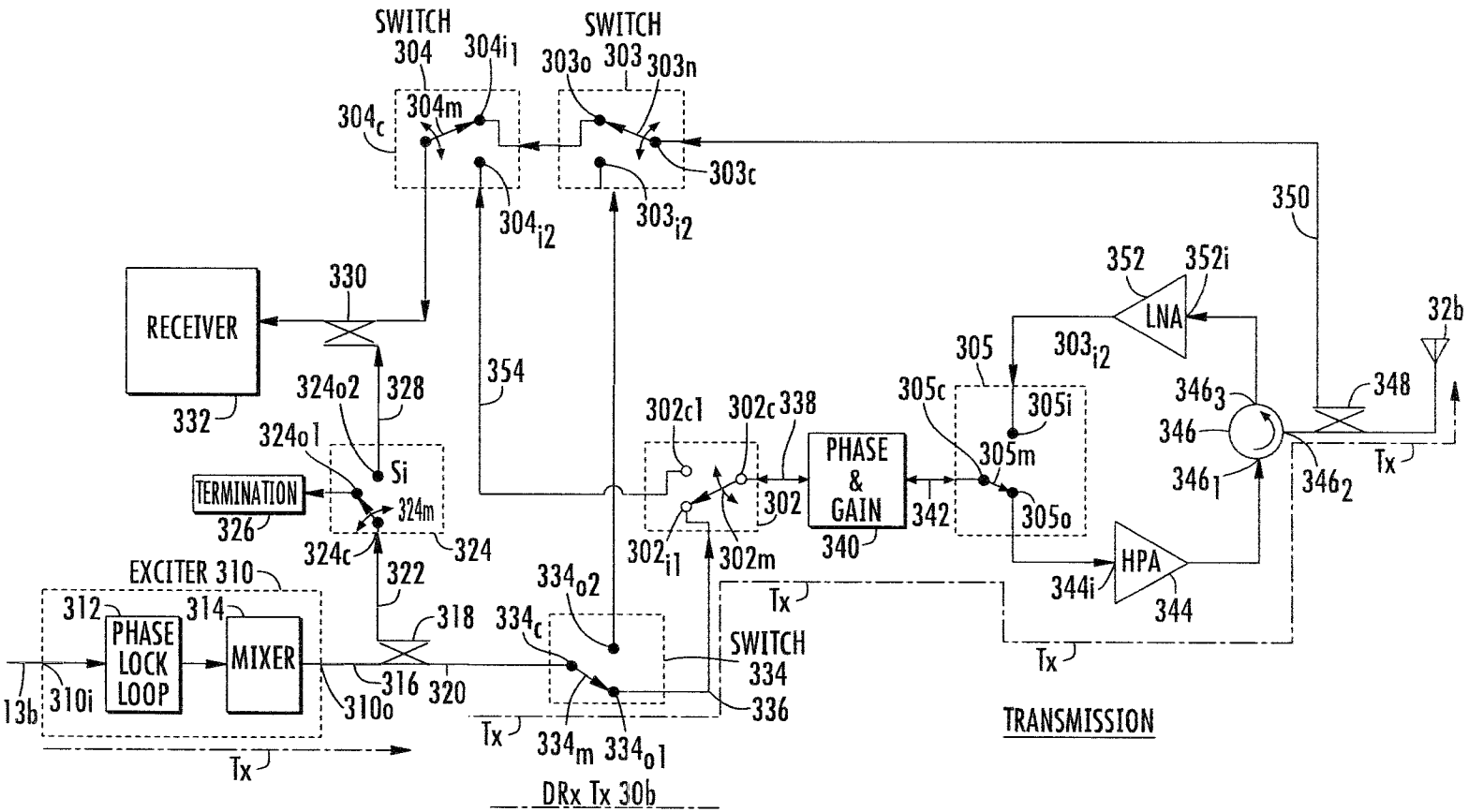
FIG. 3A is a diagram in block and schematic form illustrating more details of a DRx/Tx of FIG. 1A with switches set for transmission.

FIG. 3A is a simplified diagram in block and schematic form illustrating details of a representative Digital Receiver-Transmitter (DRx/Tx) of FIG. 1A which may be used in the arrangement of FIG. 2. The switch configuration in FIG. 3A is selected for the transmit (Tx) function and for transmit path calibration. In FIG. 3A, the representation is of DRx/Tx 30*b* of FIG. 2. DRx/Tx 30*b* of FIG. 3A receives a sample of the reference oscillator signal by way of path 13*b*. The sample of the reference signal is applied by way of an input port 310*i* of an exciter illustrated as a block 310 to a phase-lock loop (PLL) 312 of the exciter 310. Phase-lock loop 312 locks an internal oscillator (not illustrated in FIG. 3A) to a multiple of the frequency of the reference oscillation applied to port 310*i*.

The phase-locked output signal from the PLL 312 is applied from the PLL to a mixer or upconverter 314, which upconverts the phase-locked, multiplied-frequency PLL signal to the desired radio-frequency (RF) signal. In the past, the term "radio frequencies" was interpreted to mean a limited range of frequencies, such as, for example, the range extending from about 20 KHz to 2 MHz. Those skilled in the art know that "radio" frequencies as now understood extends over the entire electromagnetic frequency spectrum, including those frequencies in the "microwave" and "millimeter-wave" regions, and up to light-wave frequencies. Many of these frequencies are very important for commercial purposes, as they include the frequencies at which radar systems, global positioning systems, satellite cellular communications and ordinary terrestrial cellphone systems operate.

The phase-locked and upconverted RF signal produced at the output of mixer 314 of FIG. 3A is coupled by way of an output port 3100 of exciter 310 of FIG. 3A and by way of a path 316 to a hybrid or directional coupler 318. Those skilled in the art know that such directional couplers can provide plural samples of an applied signal with controlled relative phase and amplitude. Directional coupler 318 ideally produces reduced power (such as −3 dB) signals on paths 320 and 322, with the signal on path 320 at a phase of −90° relative to the phase on path 322. The signal on path 322 is applied to the common port 324*c* of an isolation switch ($S_i$) 324. Isolation switch 324 is illustrated by a mechanical switch symbol including a movable element 324*m* connected to common port 324*c*, movable to connect alternately to a first output contact or element 32401 and a second independent contact or element 32402. Those skilled in the art realize that electronic switches are ordinarily used for such purposes, but mechanical switch symbols are convenient and widely used for purposes of explanation. "Movable" element 324*m* of switch 324 is illustrated in FIG. 3A as being in contact with terminal, element, or port 324*i*1, which thereby connects the reduced- or half-power signal appearing or flowing on path 322 to a termination 326. Since movable contact 324*m* is not in contact with contact element 324*i*2, little or no signal flows by way of path 328 to directional coupler 330 and receiver 332, and hence the receiver 332 is isolated from the exciter signal.

In FIG. 3A, the exciter signal produced by exciter 310 and flowing through directional coupler 318 to path 320 arrives at a common terminal, contact, or port 334*c* of a further switch 334. Switch 334 includes output contacts or terminals 33401 and 33402. A movable element 334*m* makes contact with common terminal 334*c* and is illustrated as making contact with an output contact 33401. Movable contact 334*m* can be moved or switched to be in contact with terminal, contact or port 33402. In the illustrated state of switch 334, exciter signal applied to switch terminal 334*c* is routed by way of output terminal, contact or port 33401 to a path 336. Output terminal 33401 of switch 334 is connected by way of path 336 to an input port 302*i*1 of a switch 302. Switch 302 includes a common port 302*c* and a further output port 30201. A movable element 302*m* is connected to common port 302*c* and is illustrated as making contact with port 302*i*1. In this state of switch 302, exciter signal applied by way of path 336 is routed by way of common terminal 302*c* and a path 338 to a phase and amplitude control illustrated as a block 340. Those skilled in the art know that the phase and amplitude controls are adjusted, possibly under the control of a transmit or radar control computer (RCC) 92, to direct the antenna beam or beams in the desired direction. The phase- and amplitude-controlled exciter signal is coupled from block 340 by way of a path 342 to a common port 305*c* of a transmit/receive switch 305. Switch 305 includes a movable element 305*m* which is in contact with common port 305*c*, and which can selectively be coupled to a receive signal input port 305*i* or a transmit output port 3050. In the illustrated state of switch 305, movable element 305*m* makes contact with output port 3050. Port 3050 of switch 305 is connected to the input port 344*i* of a high-power amplifier (HPA) 344. The output port of HPA 344 is coupled to a port $\mathbf{346}_1$ of a circulator 346. Amplified signal to be transmitted which is coupled to circulator port $\mathbf{346}_1$ is circulated in the direction of the circulation arrow to port $\mathbf{346}_2$ and flows by way of a path of directional coupler 34B to the antenna element $\mathbf{32}_b$ of antenna array 32, which is associated with DRx/Tx 30*b*. A sample of the transmit signal appears on a path 350 and flows to a common port 303*c* of a switch 303. In FIG. 3A, the path of the exciter signals from the exciter input port 310*i* to the antenna element 32*n* is illustrated by an interrupted-dash line designated TX. Thus, with the state of the switches illustrated in FIG. 3A, each DRx/Tx of set 30 of FIG. 1 or 2 transmits signal which is synchronized at least in frequency with a multiple of the frequency of reference oscillator 12 of FIG. 2 (corresponding to exciter 34 of the reference exciter 14 of FIG. 1A).

As mentioned, FIG. 3A shows the salient switch positions within DRx/Tx 30*b* for the RF transmit mode of operation. Signals received by antenna element $\mathbf{32}_b$ of antenna array 32, which is associated with DRx/Tx 30*b* of FIG. 3A, are coupled from the antenna element through a path of directional coupler 348 back to port $\mathbf{346}_2$ of circulator 346. The receive signal coupled to port $\mathbf{346}_2$ of circulator 346 circulates to, and exits from, circulator port $\mathbf{346}_3$. The receive signal exiting circulator port $\mathbf{346}_3$ is applied to an input port 352*i* of a low-noise amplifier (LNA) 352. With the state of switch 305 illustrated in FIG. 3A, the low-noise amplified received signal stops at switch 305.

Figure 3B:
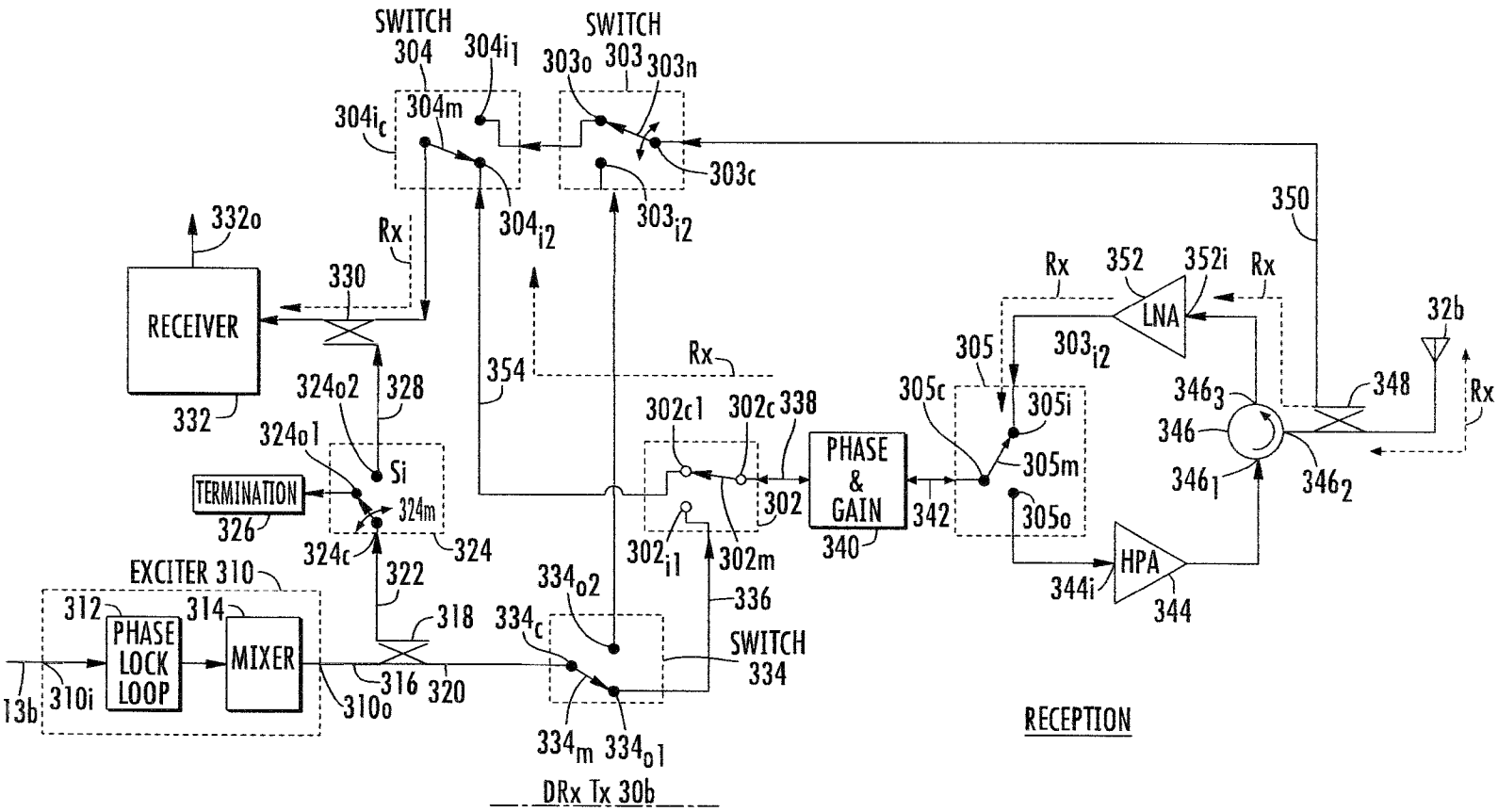
FIG. 3B shows the switches of a DRx/Tx set for reception.

FIG. 3B illustrates the switch positions of DRx/Tx 30*b* when configured for reception of RF signals. Elements of FIG. 3B corresponding to those of FIG. 3A are designated by like reference numerals. The differences in switch position between FIGS. 3A and 3B appear in switches 302, 304, and 305. The positions of switches 303 and 334 are irrelevant in the receive mode of operation. During reception, RF signals received by antenna element 32*n* are coupled through the −90° path of directional coupler 348 back to port $\mathbf{346}_2$ of circulator 346. The receive signal coupled to port $\mathbf{346}_2$ of circulator 346 circulates in the direction of the circulation arrow to circulator port $\mathbf{346}_3$, and exits from circulator port $\mathbf{346}_3$. The receive signal exiting circulator port $\mathbf{346}_3$ is applied to an input port 352*i* of a low-noise amplifier (LNA) 352. In the state of switch 305 illustrated in FIG. 3B, the receive signals are coupled from port 305*i* to 305*c*, and through the phase and amplitude control 340. The settings of phase and amplitude control 340 will ordinarily be the same as the settings for the transmit mode of operation. The phase and amplitude controlled received signals are coupled from block 340 to the common port 302*c* of switch 302, and through movable element 302*m* to output port 30201. From switch 302, the receive RF signal flows over a path 354 to input port 304*i*2 of switch 304. In the illustrated state of switch 304, the receive RF signal flows by way of movable element 304*m* to common port 304*c*, and thence by way of the −90° path of a directional coupler 330 to a conventional RF receiver illustrated as a block 332. The receiver 332 performs the function of measuring phase and gain and makes the received signals available at a port 332*o* for generic radar processing. The path of received signals flowing through DRx/Tx 30*b* in the receive switch state illustrated in FIG. 3*b* is illustrated by a dash line designated Rx.

The various DRx/Txs illustrated in FIG. 1A include signal paths in addition to the transmit signal path Tx and the receive Rx signal paths described in conjunction with FIGS. 3A and 3B. These additional signal paths include a reference signal path, a path for preparation for transmit path calibration, and a path for preparation for receive path calibration.

Figure 3C:
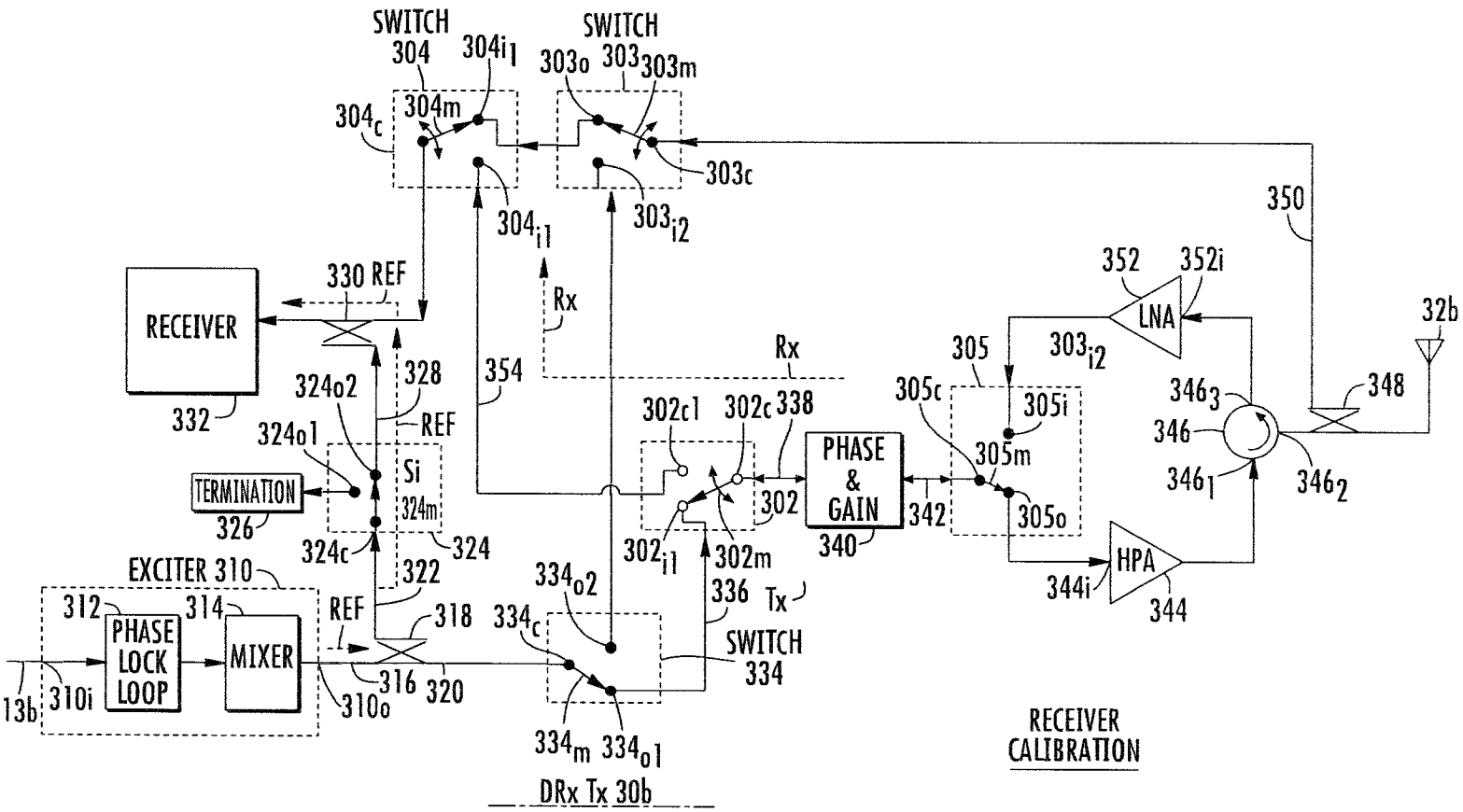
FIG. 3C shows the switches set for calibrating a receiver.

The reference signal path REF is illustrated in conjunction with FIG. 3C. FIG. 3*c* is similar to FIGS. 3A and 3*b*, differing only in the position of switch 324. The positions of switches other than switch 324 are irrelevant to the reference signal path REF. In FIG. 3C, the movable element 324*m* of switch 324 connects common terminal 324*c* with terminal 32402 and thence by way of path 328 to a port of directional coupler 330. The reference signal applied to directional coupler 330 is applied to receiver 332 as a reference for phase, to allow the various lengths of the transmit and receive signal paths of the DRx/Tx to be determined and calibrated to uniform values.

Figure 3D:
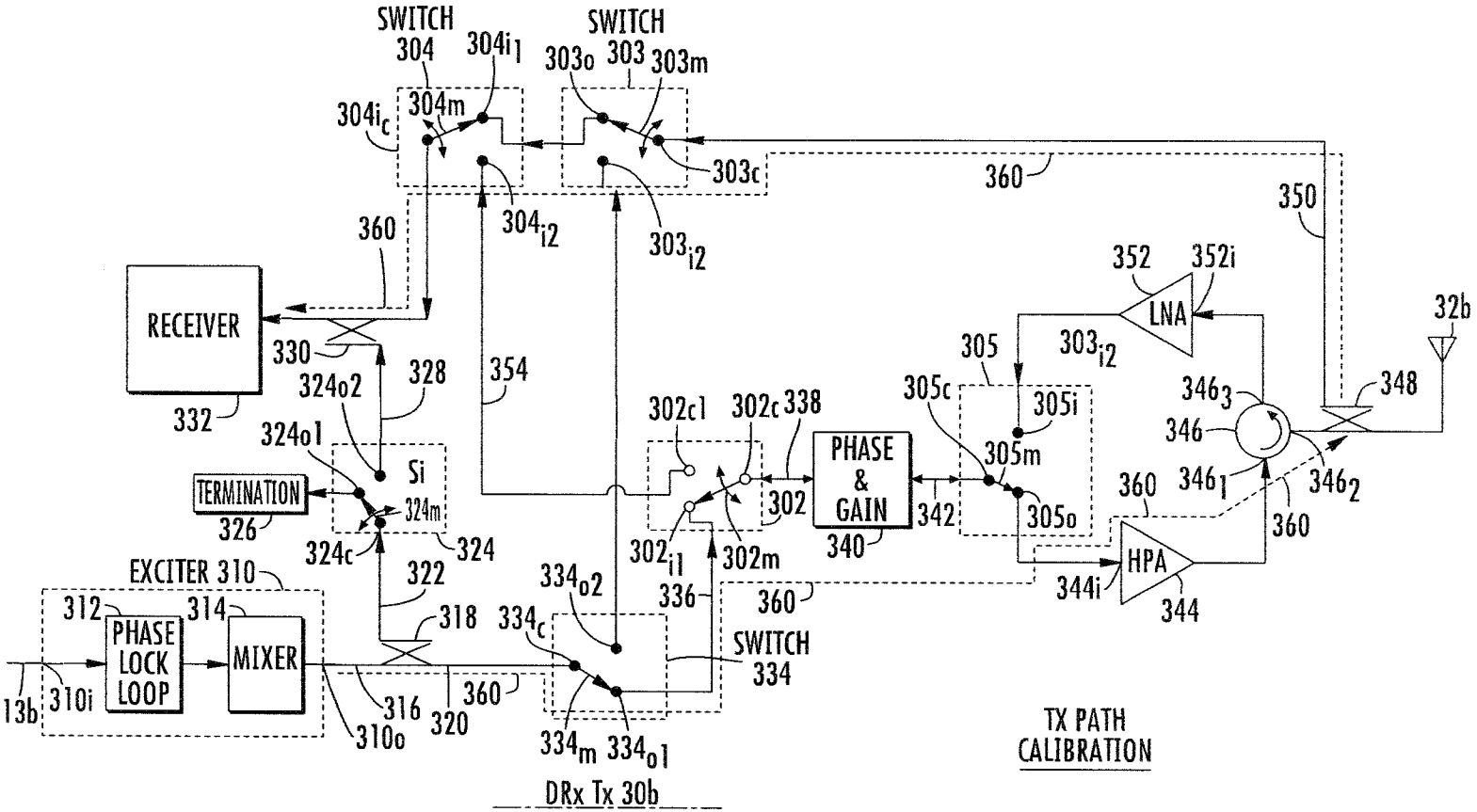
FIG. 3D shows the switches set in preparation for calibration of the transmit path.

FIG. 3D is identical to FIGS. 3A, 3B, and 3C, except for the illustrated states of the switches. The switches in FIG. 3D are set for preparation for calibration of the transmit signal paths of the associated DRx/Tx. The relevant switches are switches 334, 302, 305, 303, and 304, which take on the positions illustrated in FIG. 3D, thereby providing a path illustrated by a dash arrow designated 360. Path 360 includes the transmit path Tx of FIG. 3A together with another path portion.

Figure 3E:
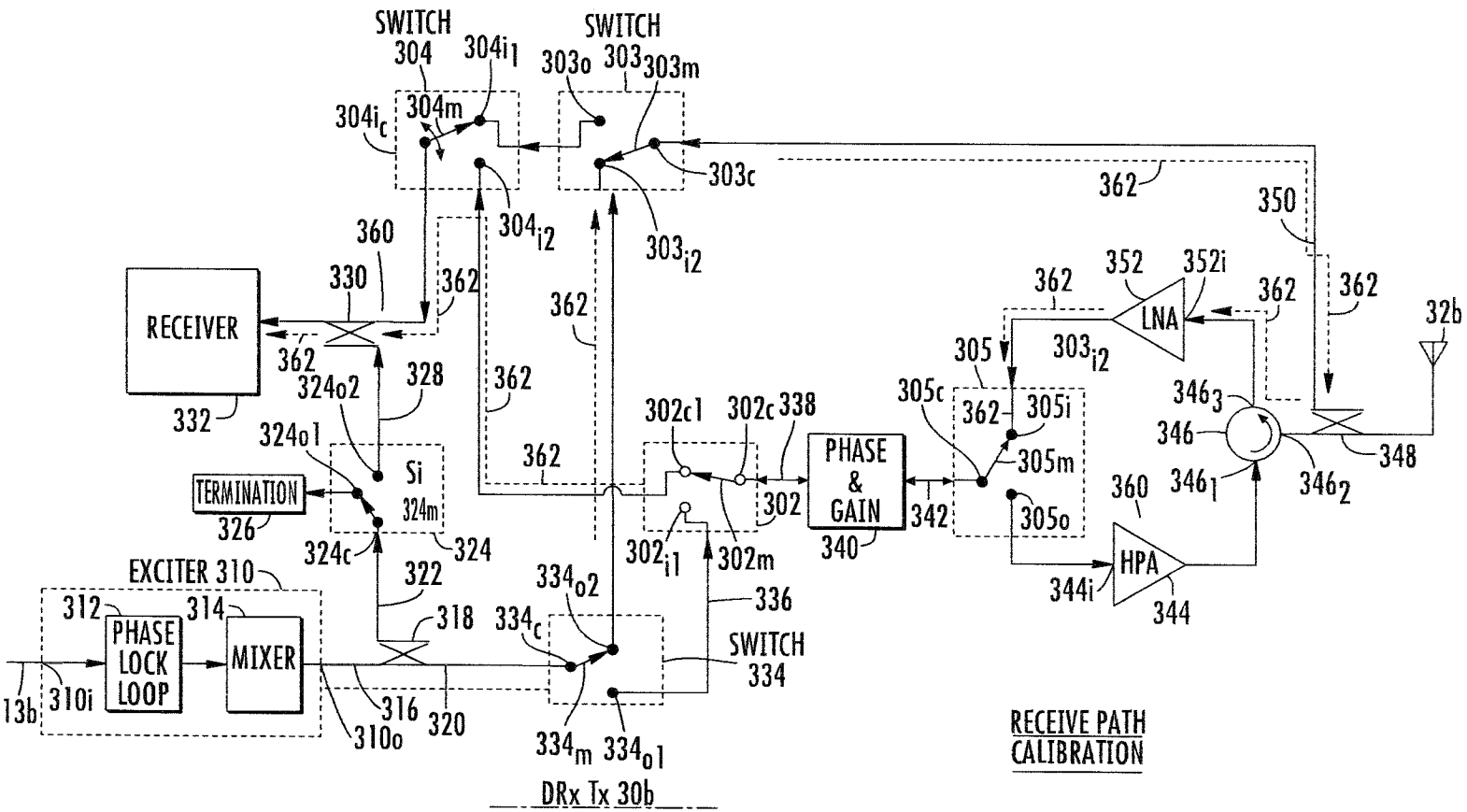
FIG. 3E shows the switches set in preparation for calibration of the receive path.

FIG. 3E is identical to FIGS. 3A, 3B, 3C and 3D, except for the illustrated states of the switches. The switches in FIG. 3E are set for preparation for calibration of the receive signal paths of the associated DRx/Tx. The relevant switches are switches 334, 303, 305, 302, and 304, which take on the positions illustrated in FIG. 3E, thereby providing a path illustrated by a dash arrow designated 362. Path 362 includes receive path RX of FIG. 3B together with another path portion.

In order to set the transmit and receive signal path lengths (delay or phase) of the various DRx/Txs of FIG. 1A to be equal, it is necessary to calibrate the paths in question. Thus, it is necessary to determine the delay of the transmit signal path (Tx of FIG. 3A) extending from the exciter of each DRx/Tx to the associated antenna in the transmit mode, and the delay of the receive signal path (Rx of FIG. 3B) extending from the associated antenna to the receiver of the DRx/Tx.

Calibration of the transmit path Tx of FIG. 3A is performed by setting the switches to the states illustrated in FIG. 3C, and applying oscillator signals from exciter 310 to receiver 332 as a reference of phase. The switches are then operated to the state illustrated in FIG. 3D, and the new phase or delay is noted at the receiver 332. This new phase or delay represents the phase or delay attributable to the path 360 (dash line in FIG. 3D). Path 360 includes the transmit path Tx of FIG. 3A, together with a path through directional coupler 348, path 350, switches 303 and 304, and directional coupler 330. The path length of that portion of path 360 which includes directional coupler 348, path 350, switch 303, switch 304 must be determined or characterized in the factory and can be de-embedded from the full loop 360. The path length of the transmit signal path Tx of FIG. 3A is determined by subtracting from the delay of path 360 of FIG. 3D the pre-characterized delay and adding the path delay of the REF signal path.

Calibration of the receive path Rx of FIG. 3B is performed by setting the switches to the states illustrated in FIG. 3C, and applying oscillator signals from exciter 310 to receiver 332 as a reference of phase or delay. The switches are then operated to the state illustrated in FIG. 3E, and the new phase or delay is noted at the receiver 332. This new phase or delay represents the phase attributable to the path 362 (dash line in FIG. 3E). Internal calibration for a DRx/Tx is determined by subtracting [the reference phase as measured by FIG. 3C from the Tx Calibration loopback phase measurement (FIG. 3D) for DRx/Tx Tx calibration and by subtracting the Rx loopback phase measurement (FIG. 3E) for DRx/Tx Rx calibration.

As so far described, the path lengths or delays attributable to the transmit (Tx) and receive (Rx) signal path lengths within the various DRx/Tx of set 30 of FIG. 1A can be individually determined. The lengths of the transmit path lengths can therefore be adjusted to be equal as between the various DRx/Tx units, and the receive path lengths can also be adjusted so as to be equal among the DRx/Txs. As mentioned, some of the calibration steps can be performed in the factory. The reference steps described in conjunction with FIG. 3C is required to establish the starting phase of the exciter 310 for both Tx and Rx path calibration within the DTxRx As mentioned in conjunction with FIG. 2, for antenna array 32 to perform the desired "adding in space" to define the desired antenna beam or beams, the phases or delays of the master signals from reference oscillator 12 applied to the input ports 30*ai*, 30*bi*, . . . , 30*ni* of the DRx/Tx units of set 30 of FIG. 2 should be identical. The delays or phases of the various paths within the DRx/Txs can be made to equal each other, but this is not sufficient. If there is any variation among the electrical lengths of the paths 13*a*, 13*b*, . . . , 13*n* of set 13 of paths of FIG. 2, the reference phase of the exciter signals applied to the various DRx/Tx units of set 30 cannot be controlled, and the desired beams cannot be achieved. It would be possible to calibrate the relative electrical lengths of the paths of set 13, selecting the longest electrical path as a reference, and adding additional electrical length to each of the shorter paths so as to make all the lengths equal. This is, however, a time-consuming and expensive procedure, which cannot be performed in a fabrication facility or factory, but in the final installation. The procedure may have to be repeated if any of the paths are damaged, as damage may change the delay or phase characteristic. If damaged, the paths may have to be replaced.

According to an aspect of the disclosure, a phase-lock loop (PLL) 312 associated with the exciter 310 of each of the DRx/Tx units of set 30 is arranged to lock at a given phase error voltage, and to count slipped cycles. This has the advantage of "automatically" setting the oscillators of all the phase-lock loops 312 to the same phase and frequency, regardless of any length disparities among the paths 13 extending from the power divider network 12A to the various DRx/Tx units of set 30.

Figure 4:
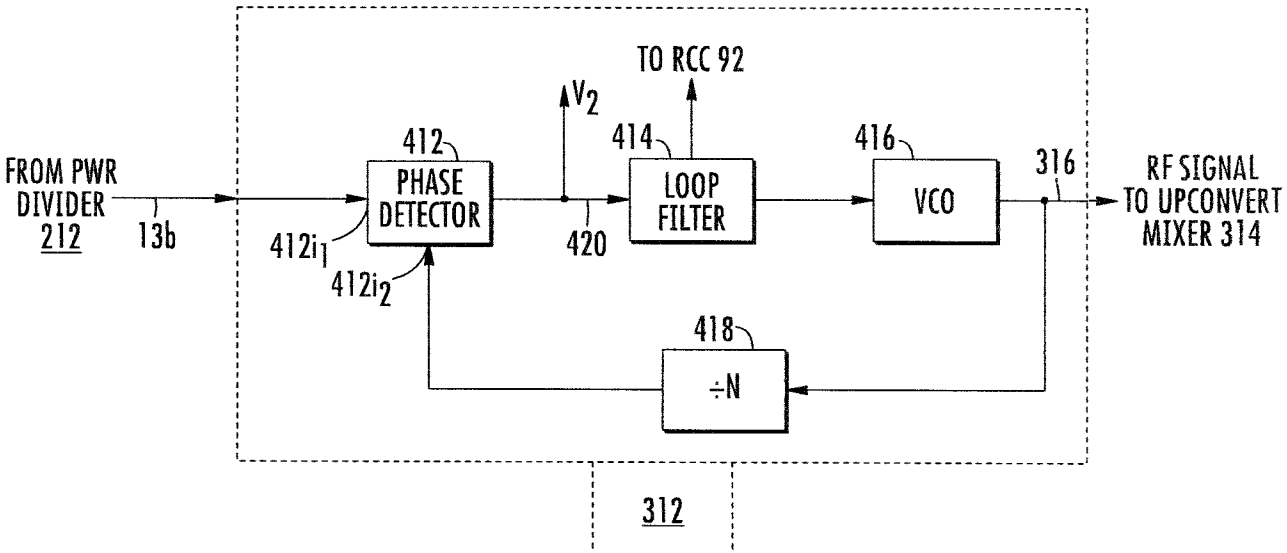
FIG. 4 is a simplified diagram illustrating details of an exciter of a DRx/Tx, showing a phase-lock loop.

FIG. 4 is a simplified diagram in block and schematic form illustrating a phase-lock loop according to an aspect of the disclosure. The phase-lock loop of FIG. 4 is designated 312, to thereby indicate that it corresponds to the phase-lock loop 312 of FIG. 3A, and thus to any phase-lock loop in any of the DRx/Tx units of set 30 of FIG. 2. It should also be noted that phase-lock loop 312 of FIG. 4 corresponds with the phase-lock loop (not separately illustrated) contained in exciter 34 of master DRx/Tx 14 of FIG. 1A. Thus, every DRx/Tx receives a sample of the reference oscillator or clock signal from source 12 (nominally 100 MHz in one embodiment). In FIG. 4, the divided reference oscillator signal frequency which is received by phase-lock loop 312 is lower than the desired frequency to be generated by the exciter 310 of FIG. 3A, and also lower than the desired transmit frequency. For example, the divided reference oscillator signals applied to exciter 312 by way of a path such as 13*b* of FIG. 3A may be at a frequency of 100 MHz, well below the RF transmit or RF frequency, which may be in the gigahertz (GHz) range. The phase-lock loop 312 phase-locks to a multiple of the reference oscillator frequency, such as 1000

MHz, and the associated mixer, such as mixer 314 of FIG. 3A (not illustrated in FIG. 4), upconverts the phase-locked signal to the desired RF frequency. In FIG. 4, the reference oscillator signal is applied by way of path 13*b* to a first input port 412*i*1 of a phase detector 412. Phase detector 412 includes a second input port 412*i*2. The output signal $v_d$ of phase detector 412 is applied by way of a path 420 to a loop filter 414, which has a low-pass function as known in the PLL arts. Filter 414 filters out or removes high-frequency components of the phase detector output signal $v_d$ and applies the resulting low-frequency components to a voltage-controlled oscillator (VCO) 416. VCO 416 oscillates at the desired phase-lock RF output frequency, which is higher than the frequency of the reference oscillator signal applied by way of path 13*b*, but which may be lower than the desired RF frequency to be transmitted. The output of VCO 416 is made available over path 316 to the associated upconverter or mixer 314, and is also applied to a divide-by-N function illustrated as a block 418. The divided-by-N output of block 418 is applied to input port 412*i*2 as a second reference for generating the phase detected output $v_d$.

In operation of the arrangement of FIGS. 1, 2, and 4, the PLL 312 of each of the DRx/Txs is set to lock at a given value of $v_d$ and to count slipped cycles.

Figure 5:
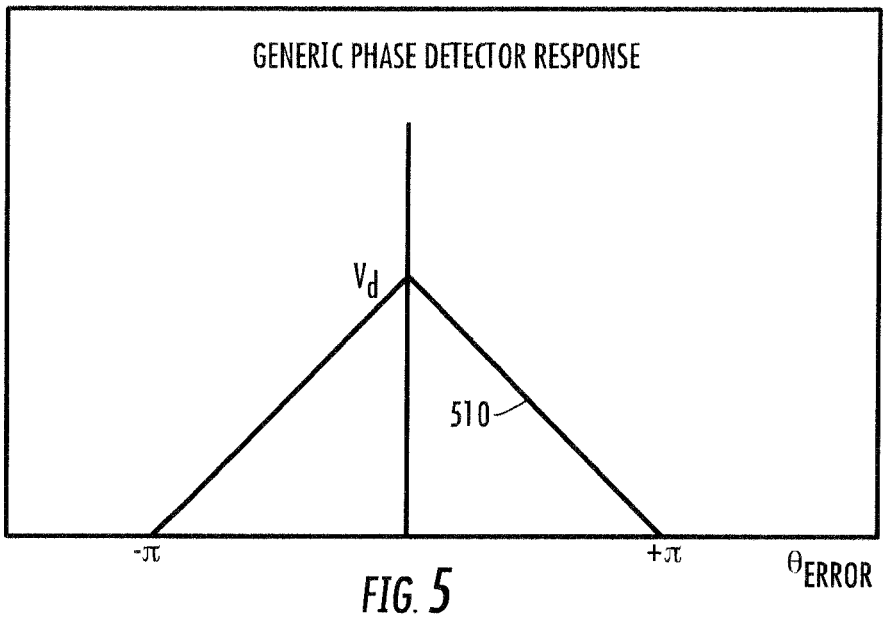
FIG. 5 plots the response of a generic phase detector of the phase-lock loop of FIG. 4.
Figure 6:
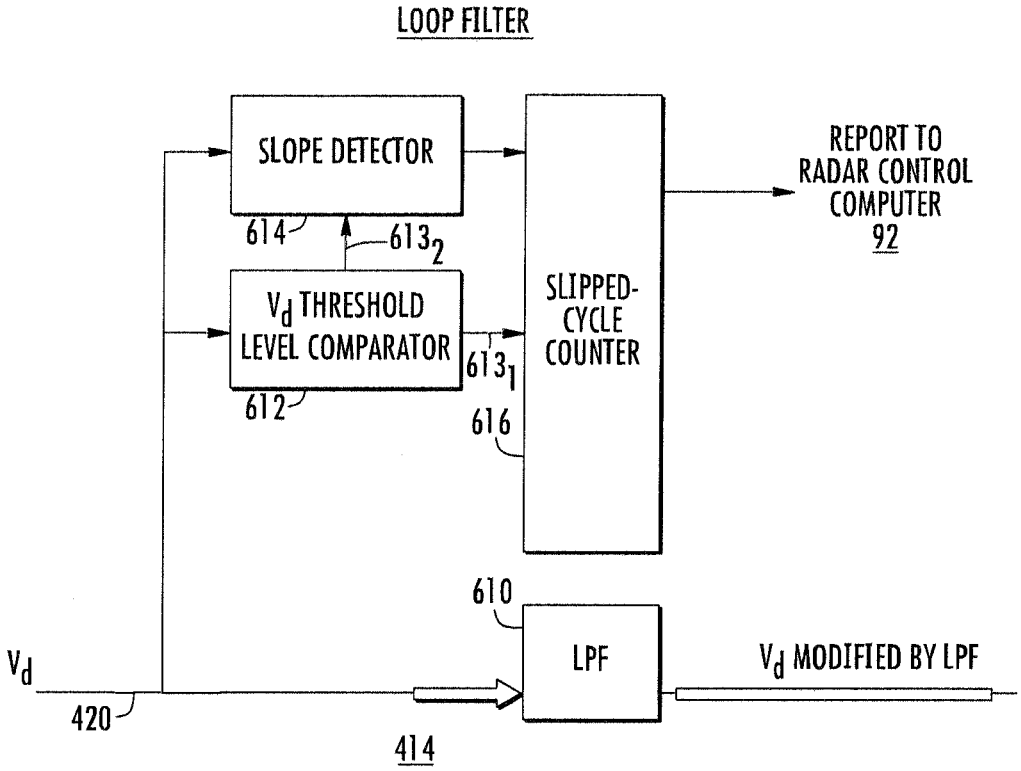
FIG. 6 is a simplified block diagram of a loop filter of the phase-lock loop of FIG. 4.

A phase detector response is illustrated by plot 510 in FIG. 5. The phase detector output is illustrated as 510 of FIG. 5. The phase detector output is a function of the phase error $\theta_{error}$ between the two phase detector input signals, which are the reference signal from power divider 12A of FIG. 2 applied by way of path 13*b* of FIG. 4, and the divided-by-N version of the VCO signal appearing at the output of divide-by-N block 418. The phase detector 412 has a characteristic such that output voltage 510 is maximized at a value of $v_d$ when the phase error is zero, as shown in FIG. 5. The Loop Filter 414 of FIG. 4 is shown in greater detail in FIG. 6. In FIG. 6, the phase detector response or output signal Vd is applied to a low-pass filter (LPF) 610, to a threshold level comparator 612, and to a slope detector 614. The output ports of the threshold level comparator 612 and the slope detector 614 are applied to input ports of a slipped-cycle counter illustrated as a block 616. The triggering of the slipped cycle counter is achieved by amplitude shift key modulation of the 100 MHz oscillator 12 between ON and OFF states under the control of radar control computer (RCC) 92. The modulation must be "ON/OFF" such that the zero-volt condition can be detected by threshold level comparator block 612 to trigger the slipped-cycle counter 616. Threshold level comparator 612 responds or detects $V_d$ equal to zero level when there is no input signal from the power divider 12A. This initiates the counter 616 by way of the connection $\mathbf{613}_1$ between the comparator 612 and the Counter Block 616 of FIG. 6. This threshold detection also resets the slope detection 614 by way of the connection $\mathbf{613}_2$ between the comparator 612 and the slope detector 614 of FIG. 6.

Figure 7:
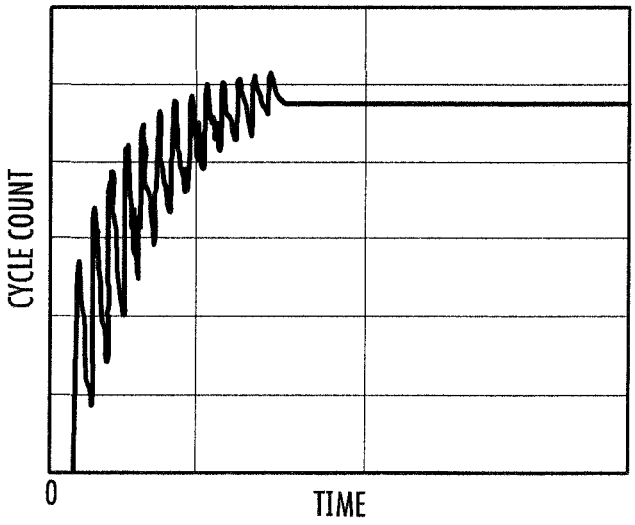
FIG. 7 is a plot of the detected ringing and settling time associated with a PLL driving to stability.

FIG. 7 illustrates a typical plot of the ringing or slipped cycles associated with Vd as the PLL 312 tries to drive the phase error to zero. This plot includes a plurality of positive and negative sloped portions. Slope detector 614 detects and reports to the counter block 616 the total number of positive and negative slopes encountered as Vd cycles toward the steady state. When Vd has reached steady state and slipped cycle counting is completed the number of cycles along with the absolute start time is reported by the counter block 616 to the master radar control computer 92 (FIG. 1A). The radar control computer 92 then takes all the start times and slipped cycle counts from all the DRx/Tx units and converts those to equivalent phase shifts. The phase shift differences are then applied to the Phase and Gain Blocks 340 of FIG. 3A of the DRx/Tx to render an aligned array. In operation of the automatic phase correction for the differences in delay or phase among the paths 13 of FIG. 2, the RCC 92 collects the start times as initiated by the AM on/off keying of the 100 MHz oscillator and the number of ringing cycles for all DRx/Tx 30. Some PLLs of set 312 may require more time to settle to steady state due to starting bias of the VCO hence more ringing cycles will be counted. The RCC corrects for the different start times by adding a phase shift to the Gain and Phase block 340 according to the ratio of $$(t2/t1)*(360 \text{ degrees})$$

where:

t1 is the start time of the DRx/Tx to be corrected; and t2 is the latest start time of the collection. The RCC corrects for the different slipped cycles by adding a phase shift to the Gain and Phase block 340 according to the ratio $$(C2/C1)*(360 \text{ degrees})$$

where:

C1 is the number of slipped cycles of the DRx/Tx to be corrected; and

C2 is the highest number of slipped cycles of the collection.

A transmitter (10) according to an aspect of the disclosure comprises an antenna array (32) and a plurality of transmitter modules (30*a*, 30*b*, . . . , 30*n*). Each of the transmitter modules (30*a*, 30*b*, . . . , 30*n*) includes a phase-lock loop (312) with a slipped-cycle counter (612, 614, 616) for determining the number of cycles of slippage before locking of the phase-lock loop (312). Each of the transmitter modules (30*a*, 30*b*, . . . , 30*n*) also includes an amplifier (344) and a phase or delay corrector (340). The transmitter (10) also comprises a source (12, 12A) of plural frequency reference signals. A set (13) of paths (13*a*, 13*b*, . . . , 13*n*) of unknown lengths is coupled to the source (12, 12A) of plural frequency reference signals and to the phase-lock loop (312) of each transmitter module (30*a*, 30*b*, . . . , 30*n*) for coupling reference signals to each transmitter module (30*a*, 30*b*, . . . , 30*n*) with unknown phase. A controller (92) is coupled to each transmitter module (30*a*, 30*b*, . . . , 30*n*), for determining the phase of the frequency reference signals at each transmitter module (30*a*, 30*b*, . . . , 30*n*) from the number of slipped cycles, and for setting the phase or delay corrector (340) to compensate an amplified signal for differences among the phases of the reference signals applied to the transmitter modules (30*a*, 30*b*, . . . , 30*n*). A set of paths (96) of controlled phase or delay is coupled to the amplifiers (344) of each transmitter module (30*a*, 30*b*, . . . , 30*n*) and to the corresponding antennas of the array (32).

A transmission system (10) comprises a frequency source (12, 12A) including plural ports (12Ao) at which mutually identical frequency reference signals are generated. An antenna array (32) includes plural antennas (32*a*, 32*b*, . . . , 32*n*), each of which defines a port. The transmission system (10) also comprises an array (30) of transmitter modules (30*a*, 30*b*, . . . , 30*n*). Each transmitter module (30*a*, 30*b*, . . . , 30*n*) includes an input port (30*ai*, 30*bi*, . . . ) to which the frequency reference signals are applied (by way of paths 13). Each transmitter module (30*a*, 30*b*, . . . , 30*n*) also includes an output port (30*ao*, 30*bo*, . . . , 30*no*) at which amplified signals are generated. A set (96) of antenna paths (96*a*, 96*b*, . . . , 96*n*) of equal lengths is provided. Each of the antenna paths (96*a*, 96*b*, . . . , 96*n*) extends from an output port (30*ao*, 30*bo*, . . . , 30*no*) of one of the transmitter modules (30*a*, 30*b*, . . . , 30*n*) to a port of an associated one of the antennas (32*a*, 32*b*, . . . , 32*n*) of the antenna array (32). Each of the reference signal paths (13*a*, 13*b*, . . . , 13*n*) of a set (13) of the of reference signal paths is connected between one of the ports (12Ao) of the frequency source (10, 12A) and the input port (30*ai*, 30*bi*, . . . , 30*ni*) of one of the transmitter modules (30*a*, 30*b*, 30*n*). The lengths of the reference signal paths (13*a*, 13*b*, . . . , 13*n*) may vary from one to the next. Each of the transmitter modules (30*a*, 30*b*, . . . , 30*n*) of the array (30) of transmitter modules includes a phase-lock loop arrangement (312) for synchronizing an associated transmitter module oscillator (416) with that one of the frequency reference signals applied to the input port (30*ai*, 30*bi*, . . . . 30*ni*) of the transmitter module (30*a*, 30*b*, . . . , 30*n*), the phase-lock loop arrangement (312) of each transmitter module (30*a*, 30*b*, . . . , 30*n*) includes a slipped-cycle counter (414, 616) for counting the number of cycles of operation slipped during locking of the phase-locked loop arrangement (312). In one embodiment of the transmission system (10), a processor (92) determines from the number of slipped cycles the phase or delay of each reference signal paths reference signal paths (13*a*, 13*b*, . . . , 13*n*). In a preferred embodiment, a phase shifter or delay element (340) is associated with each transmitter module (30*a*, 30*b*, . . . , 30*n*) and is set to a phase or delay value which tends to equalize the phase or delay between the source (12, 12A) and the associated antenna (32*a*, 32*b*, . . . , 32*n*) port. A particularly advantageous embodiment further comprises a phase shifter or delay element (340) associated with each transmitter module (30*a*, 30*b*, . . . , 30*n*) set to a phase or delay value which tends to equalize the phase or delay between the source (12, 12A) and the port of the associated antenna (32*a*, 32*b*, . . . , 32*n*).

A method for transmitting electromagnetic signals according to an aspect of the disclosure comprises the steps of generating (on paths 13) plural replicas (12A) of a frequency reference signal (12), and applying each of the plural replicas by way of a path (13) of uncontrolled delay to a transmit module of a set (30) of transmit modules. Within each of the transmit modules (30*a*, 30*b*, . . . , 30*n*), a controlled oscillator (416) is phase locked to one of the plural replicas. The number of slipped cycles which occur during the phase locking is counted (616). From the number of the slipped cycles, the electrical delay of the corresponding path of uncontrolled delay is determined (92). The output signal of each of the controlled oscillators (416) is delayed (340) by a selected delay. The selected delay is selected to nominally equalize the phases of the delayed output signals of all of the controlled oscillators. The delayed output signal of each of the controlled oscillators is applied to a corresponding antenna element of an antenna array (32). A particular mode of this method further comprises the step of imposing a further delay on the delayed output signals of each of the controlled oscillators to direct a beam of electromagnetic radiation from the antenna array.

A method for transmitting electromagnetic signals comprises the step of generating (on paths 13) plural replicas (12A) of a frequency reference signal (12). Each of the plural replicas is applied by way of a path (13) of uncontrolled length to a phase-lock loop arrangement (312) associated with a transmitter module (30) of a set (30) of transmitter modules. A count is made of the number of slipped cycles which occur during locking of each phase-lock loop arrangement. From the number of slipped cycles, a determination is made of the electrical length of each path of uncontrolled length. A phase shift is introduced into each transmitter module which, taken with the phase shifts of the other transmitter modules, equalizes the nominal phase at the outputs of the transmitter modules. The output of each transmitter module is applied to an antenna element of the array for transmitting electromagnetic signals.

What is claimed is:

1. A transmitter comprising:

an antenna array;

a plurality of transmitter modules, each of which includes a phase-lock loop with a slipped-cycle counter for determining the number of cycles of slippage before locking of said phase-lock loop, and each of which modules also includes an amplifier and a phase or delay corrector;

a source of plural frequency reference signals;

a set of paths of various lengths coupled to said source of plural frequency reference signals and to the phase-lock loop of each module for coupling reference signals to each module with various phases;

a controller coupled to each module, for determining the phase of the reference signals at each module from the number of slipped cycles, and for setting said phase or delay corrector to compensate an amplified signal for differences among the phases of the reference signals applied to the modules; and a set of paths of controlled phase or delay coupled to said amplifiers of said modules and to the antennas of said array.

2. A transmission system, comprising:

a frequency source including plural ports at which mutually identical frequency reference signals are generated;

an antenna array including plural antennas, each antenna defining a port;

an array of transmitter modules, each module including an input port to which said frequency reference signals are applied, and each also including an output port at which amplified signals are generated;

a set of antenna paths of equal lengths, each of said antenna paths extending from an output port of one of said transmitter modules to a port of an associated one of said antennas of said array;

a set of reference signal paths, each of said reference signal paths being connected between one of said ports of said frequency source and the input port of one of said transmitter modules, the lengths of said reference signal paths varying from one to the next;

each of said transmitter modules of said array of transmitter modules including a phase-lock loop arrangement for synchronizing the associated transmitter module oscillator with that one of said frequency reference signals applied to the input port of the transmitter module, said phase-lock loop of each transmitter module including a slipped-cycle counter for counting the number of cycles of operation slipped during locking of said phase-locked loop;

a controller for determining from the number of slipped cycles the phase or delay of each reference signal path; and a phase shifter or delay element associated with each transmitter module, set to a phase or delay value for equalizing the phase or delay between the source and the port of the associated antenna.

3. A method for transmitting electromagnetic signals, said method comprising the steps of:

generating plural replicas of a frequency reference signal;

applying each of said plural replicas by way of a path of fixed delay to a transmit module of a set of transmit modules;

within each of said transmit modules, phase locking a controlled oscillator to one of the plural replicas;

counting the number of slipped cycles which occur during said phase locking within each of said transmit modules;

from the number of said slipped cycles, determining the electrical delay of a corresponding path of uncontrolled delay;

delaying the output signal of each of said controlled oscillators by a selected delay, which selected delay is selected to nominally equalize the phases of the delayed output signals of all of said controlled oscillators; and applying the delayed output signals of each of said controlled oscillators to an antenna element of an antenna array.

4. A method according to claim 3, further comprising the step of imposing a further delay on said delayed output signals of each of said controlled oscillators to direct a beam of electromagnetic radiation.

5. A method for transmitting electromagnetic signals, said method comprising the steps of:

generating plural replicas of a frequency reference signal;

applying each of said plural replicas by way of a path of fixed length to a phase-lock loop including a slipped-cycle counter, for locking the phase of a phase-locked oscillator of each phase-lock loop to a phase of the corresponding one of said plural replicas;

determining, from the number of slipped cycles occurring during locking of each phase-lock loop, the nominal phase of each of the plural replicas at said phase-lock loop;

amplifying a signal derived from each phase-lock loop to thereby generate amplified signals;

adjusting the phase of each amplified signals so that all of said amplified signals have a common phase reference; and coupling said amplified signals with common reference phases by way of paths of equal lengths to an array of antennas for transmission thereof.

* * * * *